United States Patent [19]

Senyitko

[11] 4,408,523

[45] Oct. 11, 1983

[54] ELECTRIC IMPRINTER WITH ROLLER PLATEN POSITIONAL CONTROL

[75] Inventor: Erwin J. Senyitko, Eastlake, Ohio

[73] Assignee: DBS, Inc., Randolph, Mass.

[21] Appl. No.: 291,969

[22] Filed: Aug. 11, 1981

[51] Int. Cl.[3] ..... B41L 47/46

[52] U.S. Cl. ..... 101/56; 101/269

[58] Field of Search ..... 101/269, 56; 271/262, 271/263; 400/50, 56, 54, 57

[56] References Cited

U.S. PATENT DOCUMENTS

| | | | |
|---|---|---|---|
| 3,800,700 | 4/1974 | McInnis et al. | 101/269 |
| 3,890,899 | 6/1975 | Brugge et al. | 101/269 |
| 4,085,675 | 4/1978 | Yoshikawa et al. | 101/269 |
| 4,270,453 | 6/1981 | Strohschneider | 101/269 |

FOREIGN PATENT DOCUMENTS

| | | | |
|---|---|---|---|
| 481516 | 7/1975 | Australia | 101/269 |
| 1496452 | 2/1976 | United Kingdom | 271/263 |

*Primary Examiner*—E. H. Eickholt
*Attorney, Agent, or Firm*—Gerald J. Ferguson, Jr.; Joseph J. Baker

[57] ABSTRACT

An imprinter having a roller platen assembly movably mounted on a head member for imprinting data from a printing plate such as a credit card onto a form positioned over the plate. The roller platen assembly has a reciprocally driven carriage means containing at least one removably mounted cartridge containing at least one row of roller platens mounted therein in parallel, spaced apart relationship to each other. A plurality of backup rollers are rotatably mounted within said roller platen assembly, each in contact and vertical alignment with each of the platen rollers when the cartridge means is in position within the carriage means. At least one of the roller platens is in contact with the raised printing elements of the printing plate at all times during each printing cycle of the imprinter to thereby lessen any tendency for smudging of the form to occur.

3 Claims, 17 Drawing Figures

ELECTRIC IMPRINTER WITH ROLLER PLATEN POSITIONAL CONTROL

BACKGROUND OF THE INVENTION

This invention relates generally to an imprinting machine and, more particularly, to a data recorder for recording credit transactions from a printing plate such as a credit card onto a form positioned thereover.

In recent years, business transactions have come to include large volumes of credit buying. Hundreds or even thousands of credit transactions are recorded in numerous businesses in a single day. In a typical credit transaction, source recording devices are used to record on a form the customer name and account number from a removable credit card as well as additional fixed and variable data such as the establishment's name and address as well as the date and amount of the transaction.

The imprinted account number and outer data is in a format and type style suited to be read by optical character recognition (OCR) equipment at a central billing center where the credit transaction data is processed, customers are billed and the businesses credited.

In order to ensure error-free reading by the OCR equipment and thus, correct debiting and crediting, the imprinted data must not only itself be sharp and clear but the areas adjacent thereto must be as free as possible from smudges or other miscellaneous marks which the OCR equipment may attempt to read. Such smudging is often caused by imprinting devices of the prior art as the reciprocating roller platen thereof drops off of the data (such as the customer account number) embossed on the card as raised printing elements to the surface of the card during or at the completion of the imprinting stroke. A typical imprinter where this may occur is disclosed in U.S. Pat. No. 3,965,820.

Thus, it is one of the principle objects of this invention to provide a novel device which is capable of clear, sharp and smudge-free imprinting of forms with data from a credit card or other embossed source.

It is another object of this invention to provide a novel device capable of double stroke imprinting which results in equivalent or better carbon transfer with less force on the type thus giving better impressions and longer credit card life.

It is yet another object of this invention to provide a unique, reciprocating roller platen assembly for an imprinting device wherein the print rollers are contained in a removable cartridge which enables them to be replaced without getting ink on the fingers of the user.

It is a still further object of this invention to provide a roller platen assembly utilizing a plurality of platen rollers which enables the imprinting stroke to be considerably shorter which, in turn, means that any length of impression can be accommodated with a compact driving mechanism making the overall machine small, compact, and economical.

It is still another object to provide an imprinter with means for unlocking the head to remove the credit card and form in the event of electrical failure or other malfunction during the imprinting cycle.

It is another object to provide an imprinter with means to return the roller platen assembly to its home position whenever the head is opened in the middle of an imprinting cycle.

It is also an object to provide an imprinter with means for preventing the operation thereof if the data source and/or form to be imprinted is too thick.

Other objects, features, and advantages will appear hereinafter as the description proceeds.

DETAILED DESCRIPTION OF THE PREFERRED EMBODIMENT

Figures 1, 2:
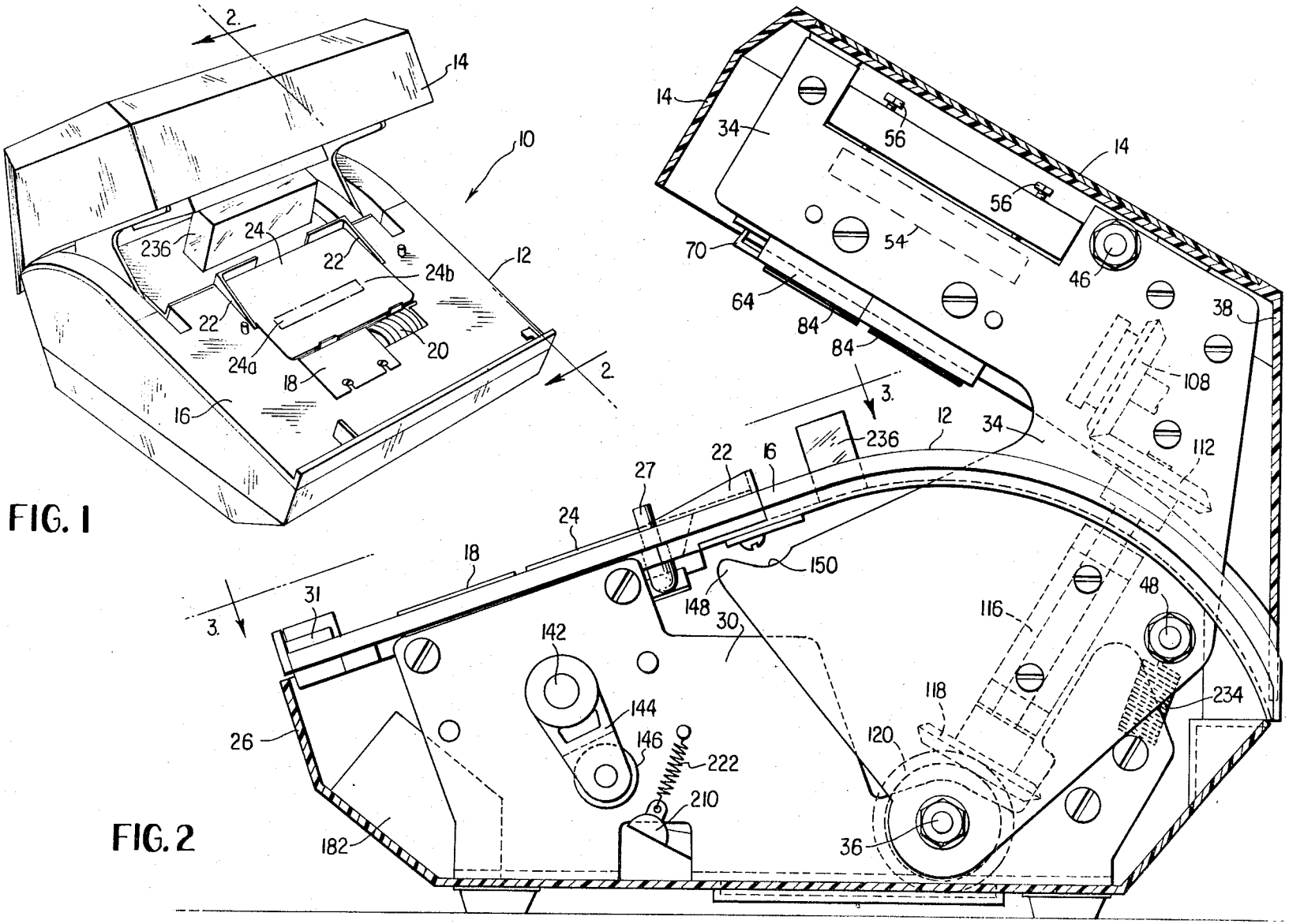
FIG. 1 is a perspective view of the imprinter of the present invention with the head assembly open.
FIG. 2 is a cross-sectional view taken along the lines 2—2 of FIG. 1.

Referring to the drawings where like characters of reference indicate like elements in each of the several views, in FIG. 1, there is shown an imprinter 10 in accordance with the invention comprising a base 12 and a head 14 pivotably mounted thereon. The base 12 has a bed 16 containing a plate 18 having raised printing elements comprising the name and address, for example, of the establishment using the imprinter and a plurality of rotatable wheels 20 which can be set with variable data such as the date. A pair of brackets 22 define an area on the bed 16 for receiving a conventional credit card 24, the card having data such as a customer's name and account number embossed thereon as raised printing elements indicated in phantom line at 24*a*. Data from sources 18, 20 and 24 is imprinted on a form 25 (see phantom lines in FIGS. 3–5) placed thereover. Although not shown, a variable amount wheel for the transaction amount may also be conventionally employed in bed 16. The bed 16 is positioned on the housing 26 and secured thereto by screws (not shown). The base 12 includes side plates 28,30 also secured to the housing 26. Resiliently biased projections 27 and stops 29,31 define the area in which the form 25 is placed to ensure proper imprinting.

Figure 3:
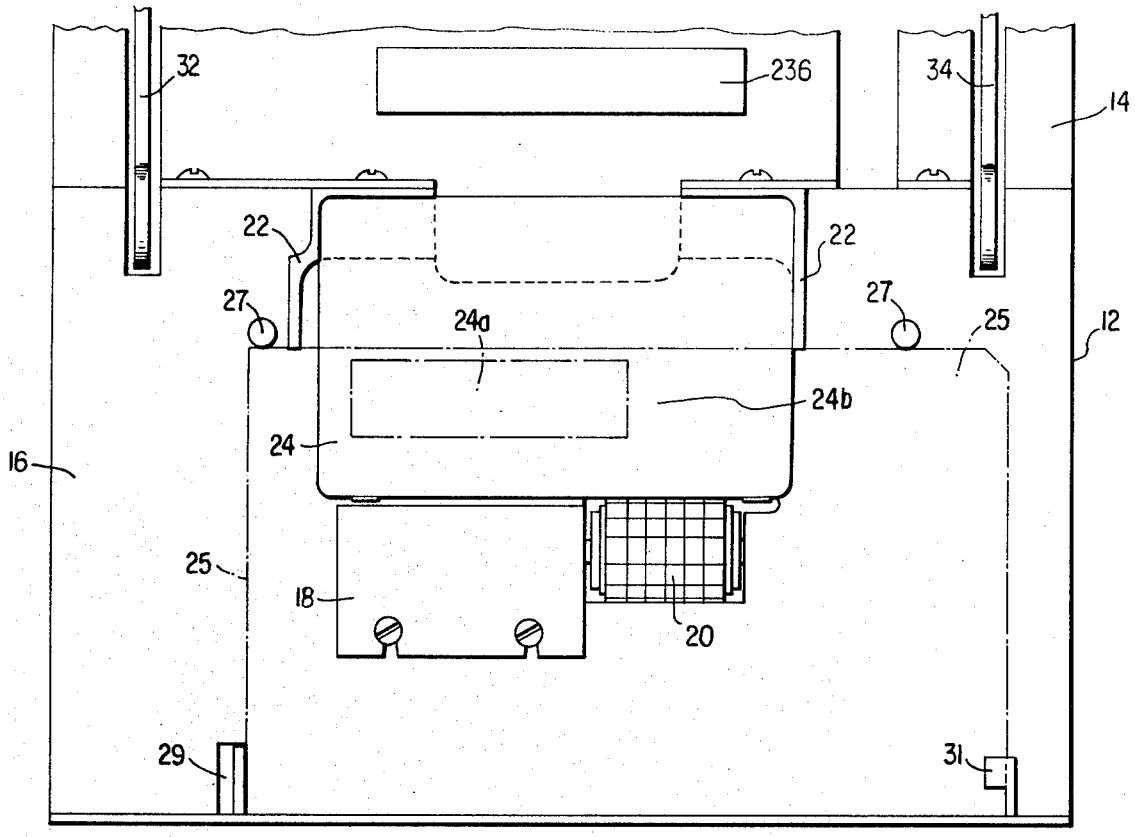
FIG. 3 is a plan view of the bed of the imprinter taken along lines 3—3 of FIG. 2.

Referring now to FIGS. 2 and 3, the head 14 has a pair of spaced-apart arms 32,34 which are rotatably mounted on the side plates 28,30, respectively, by means of shaft 36 to enable the head 14 to pivot toward and away from the bed 16. The head 14 has a housing 38 attached to the arms 32,34 which it encloses as well as the head assembly 40. The head assembly 40 consists generally of a roller platen carriage 42 adapted to be moved in a path across the bed 16 to effect an imprinting operation and a drive mechanism 42 therefor. Spacer rods 46,48 are provided for maintaining the arms 32,34 rigid in their parallel, spaced-apart relationship to each other. The roller platen carriage 42 has a pair of arms 50,52 integrally formed therewith at each end thereof which slidably engage a backup plate 54 mounted by screws 56 between the arms 32,34. The roller platen carriage 42 includes a plurality of spaced-apart recesses 58 each containing a backup roller 60 maintained in their respective recess 58 by means of oppositely disposed lips 62. A frame 64 is also provided which is removably mounted within the roller platen carriage 42 below the backup rollers 60. The frame 64 is held within the roller platen carriage 42 by means of a longitudinally extending projection 66 on one edge thereof which is inserted in a correspondingly shaped groove 68 formed in the body of the roller platen carriage 42. A resilient catch 70 is integrally formed on the other side of the frame 64 which engages a ridge 72 formed in the roller platen carriage 42 to maintain the frame 64 therewithin. Flexure of the catch 70 out of engagement with ridge 72 will enable the frame 64 to be easily removed from the roller platen carriage 42.

Figure 9:
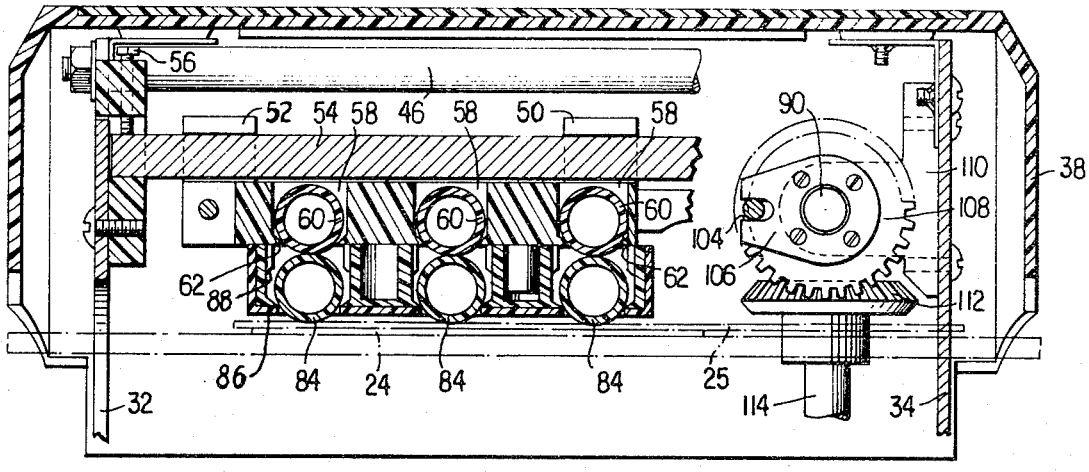
FIG. 9 is a cross-sectional view of the imprinter head taken along the lines 9—9 of FIG. 7.
Figure 10:
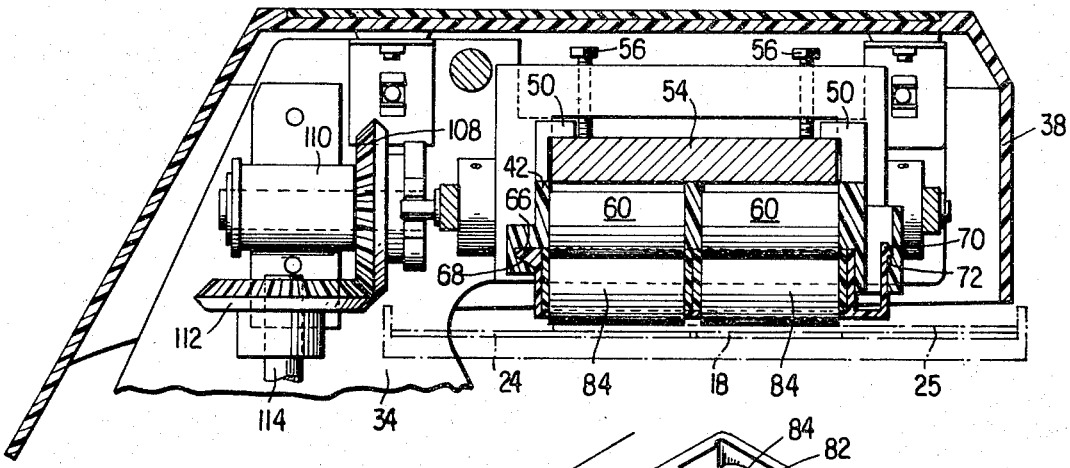
FIG. 10 is a cross-sectional view of the imprinter head taken along the lines 10—10 of FIG. 7.
Figure 11:
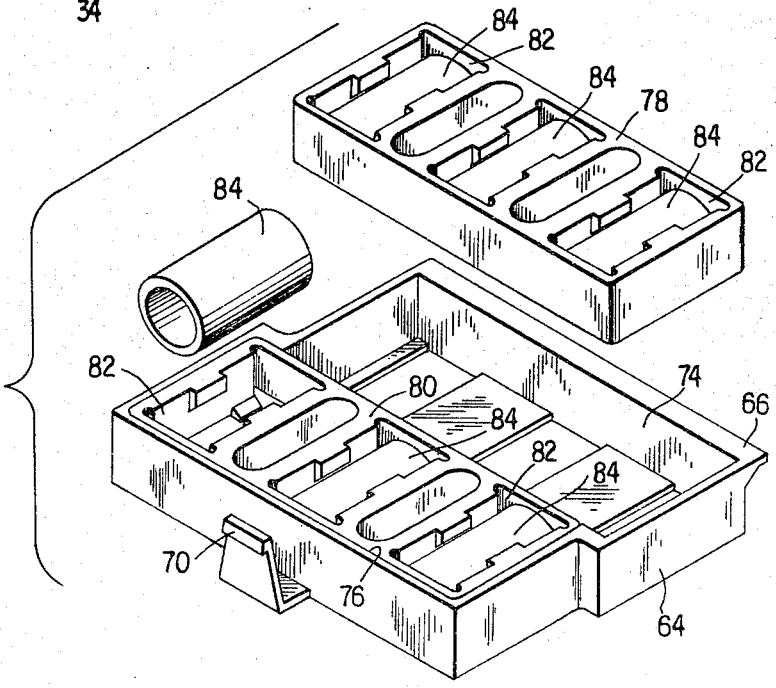
FIG. 11 is a perspective view of the roller platen cartridge and holder therefor.
Figure 12:
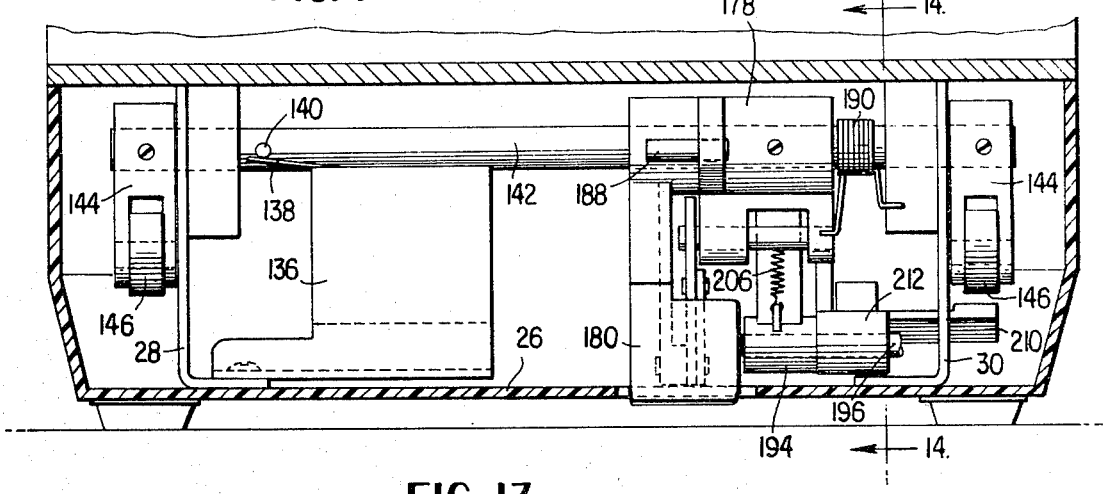
FIG. 12 is a front view of the base of the imprinter in partial cross-section.
Figure 13:
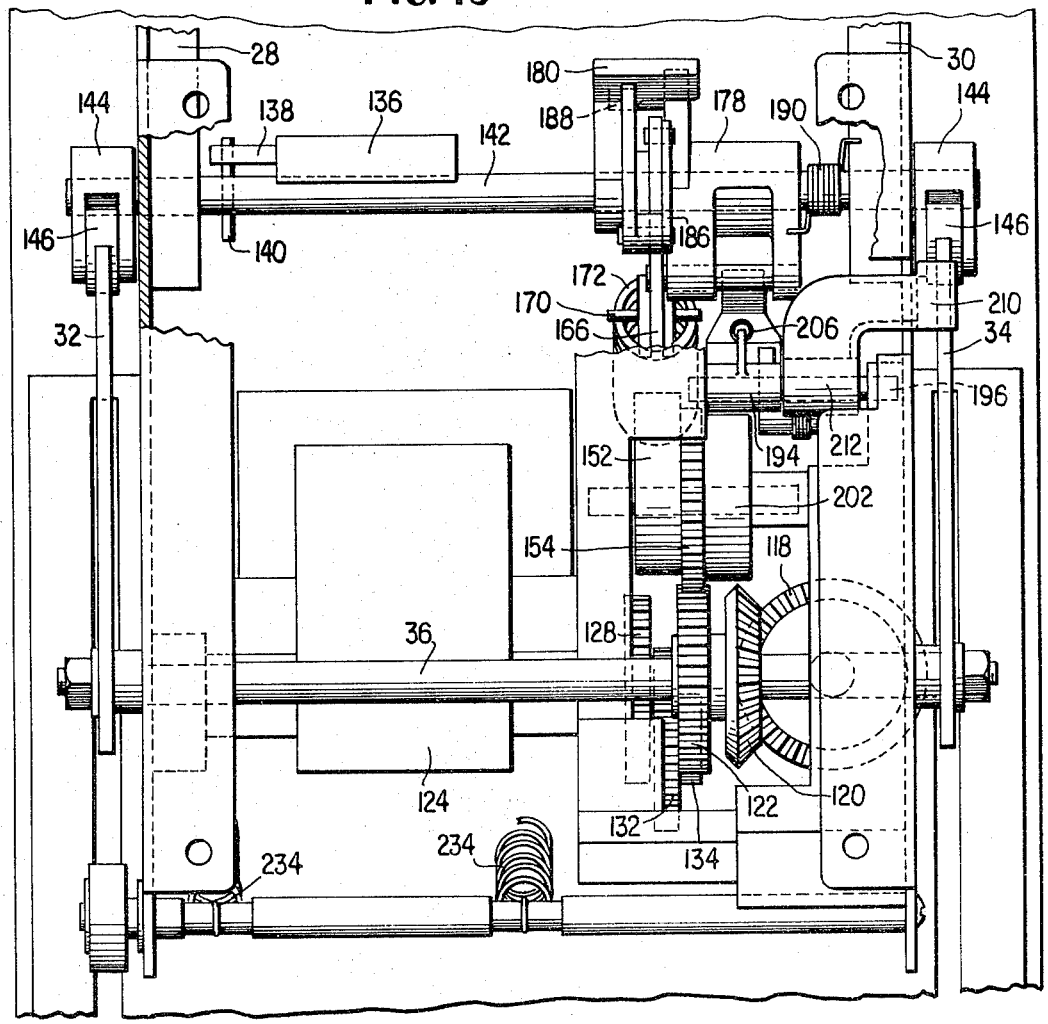
FIG. 13 is a bottom view of a portion of the imprinter.

In the embodiment herein disclosed, as best seen in FIG. 11, the frame 64 has a pair of offset, rectangular-shaped recesses 74,76 each of which is adapted to receive a cartridge 78,80 respectively. Each cartridge 78,80 has a plurality of parallel, spaced-apart recesses 82 for receiving either a plain or inkable roller platen 84. The roller platens 84 contained in each separate cartridge 78,80 would all be of either the plain or inkable type, however, the cartridges 78,80 themselves could both be of the plain or inkable type or one of each, depending on the type of imprinting desired as will be more fully described later. Further, the roller platen carriage 42 and frame 64 therefor could be designed to accommodate one cartridge of either the plain or inked type if, for example, only the data from the credit card 24 was desired to be imprinted on the form. The roller platens 84 are rotatably mounted within each recess 82 by means of spaced-apart, oppositely disposed projections 86 on the bottom thereof and by means of oppositely disposed projections 88 on the top thereof. As can best be seen by referring to FIGS. 9 and 10, when the frame 64 containing the cartridges 78,80 is in place within the roller platen carriage 42, the backup rollers 60 are in contact and vertical alignment with the respective roller platen 84 beneath it. The backup rollers 60 serve to reverse the direction of rotation of the roller platens 84 so that there is no sliding. As the roller platen carriage 42 is pulled forward by the mechanism to be presently described, the velocity of the points of contact of the roller platens 84 with the form to be imprinted and the backup rollers 60 with the backup plate 54 is zero, thus no sliding. It should be noted that the backup rollers 60 do not have to be the same diameter as the roller platens 84.

The roller platen carriage 42 is reciprocally driven through its printing cycle by means of a pair of cranks 83,85 which are connected to a shaft 90 which, in turn, is journaled for rotation in a bearing block 92 secured to arm 32. A connecting rod 94 is pivotably secured to crank 83 by a pin 96 and to the roller platen carriage 42 by means of shaft 98 extending therethrough. Similarly, the connecting rod 100 is pivotably secured to crank 85 by a pin 102 and to the shaft 98. The pin 102, however, extends a distance and engages a recess 104 in a drive lever 106 such that as the drive lever 106 rotates, the roller platen carriage 42 reciprocates back and forth on the backup plate 54. The drive lever 106, in turn, is connected to a bevel gear 108 which is journaled for rotation in a bearing 110. The bevel gear 108 is driven by another bevel gear 112 in which it is in engagement. The bevel gear 112 is connected to a shaft 114 also journaled for rotation in a bearing 116 mounted on arm 32. The shaft 114 extends into the base 12 to another bevel gear 118 connected to the end thereof as can best be seen by referring to the phantom lines thereof in FIGS. 2 and 6. The bevel gear 118 is in driven engagement with another bevel gear 120 rotatably mounted on shaft 36. The aforedescribed arrangement of bevel gearing enables the head 14 to be pivoted relative to the base 12 from its open to closed position. When so pivoted, the bevel gear 118 merely travels around the bevel gear 120 always staying in driving engagement therewith.

Figure 14:
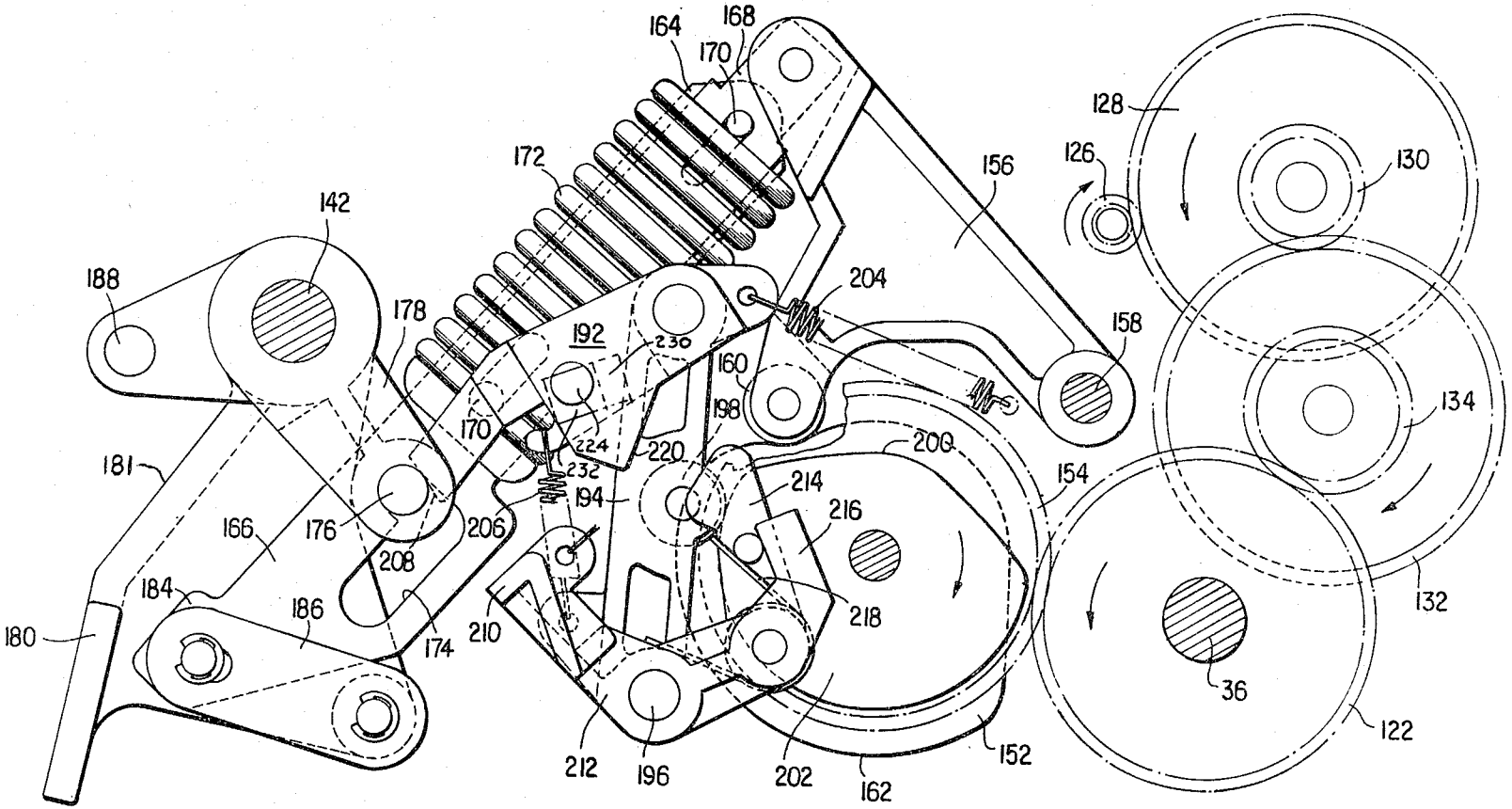
FIG. 14 is an elevational view of a part of the drive mechanism taken along the lines 14—14 of FIG. 12.

The bevel gear 120 is attached to and driven by a gear 122 rotatably mounted on shaft 36. The gear 122 is, in turn, driven by an electric motor 124 via a speed reduction gear train comprising gear 126 connected to the motor shaft and intermediate gears 128,130,132 and 134 as can be seen in FIG. 14.

Figure 8:
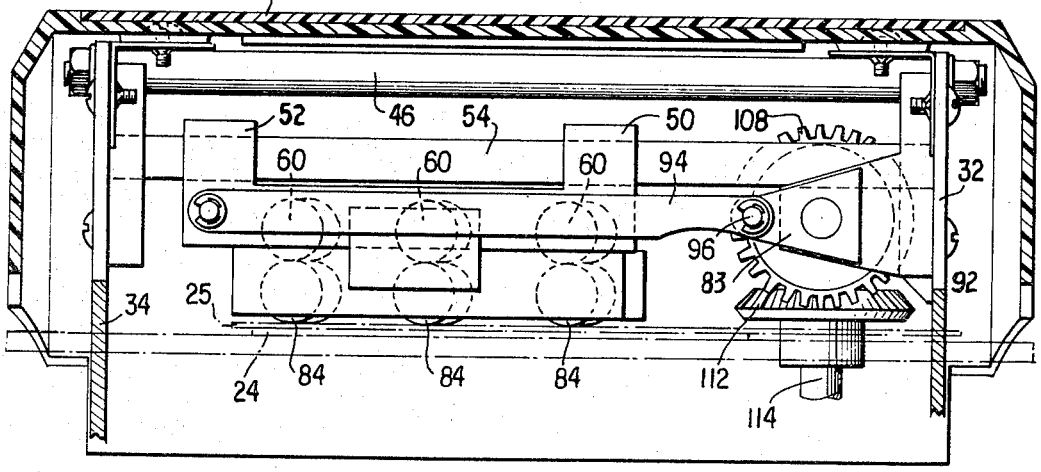
FIG. 8 is an end view of the imprinter head taken along the lines 8—8 of FIG. 7.

The motor 124 is energized to start the print cycle by means of a switch 136 having an actuating arm 138. The actuating arm 138 is positioned adjacent a pin 140 secured to a lock arm shaft 142 rotatably mounted between side plates 28,30. The lock arm shaft 142 has a pair of lock arms 144 secured to the ends thereof, each lock arm 144 having a roller 146. As the arms 32,34 rotate downward as the head 14 is moved to its closed position, projections 148 on the arms 32,34 engage rollers 146 of the lock arms 114 rotating same. As the lock arm shaft 142 in turn rotates, switch 136 is closed via actuating arm 138 and pin 140 to energize the motor 124 to start the print cycle. The switch 136 is closed when the lock arm shaft 142 is rotated approximately 15 degrees from its at rest position and against the influence of spring 190. If the thickness of form 25 is too great, the lock arm shaft 142 is incapable of rotating the aforementioned number of degrees, thus the motor 124 will not start, the lock arms 144 will not move into latching position in recess 150 and the head 14 will reopen under the influence of springs 234. Thus, by adjusting the position of the switch actuating arm 138 relative to the pin 140, the relationship between a predetermined form thickness and actuation of the device can be accurately controlled. One print cycle consists of movement of the roller platen carriage 42 from its home position at the left of the head assembly 40 as viewed in FIG. 8 to its actuated position at the right thereof and back to its home position whereupon a mechanism to be hereinafter described rotates the lock arm shaft 142 to thereby open switch 136 shutting off the motor 124.

Figure 6:
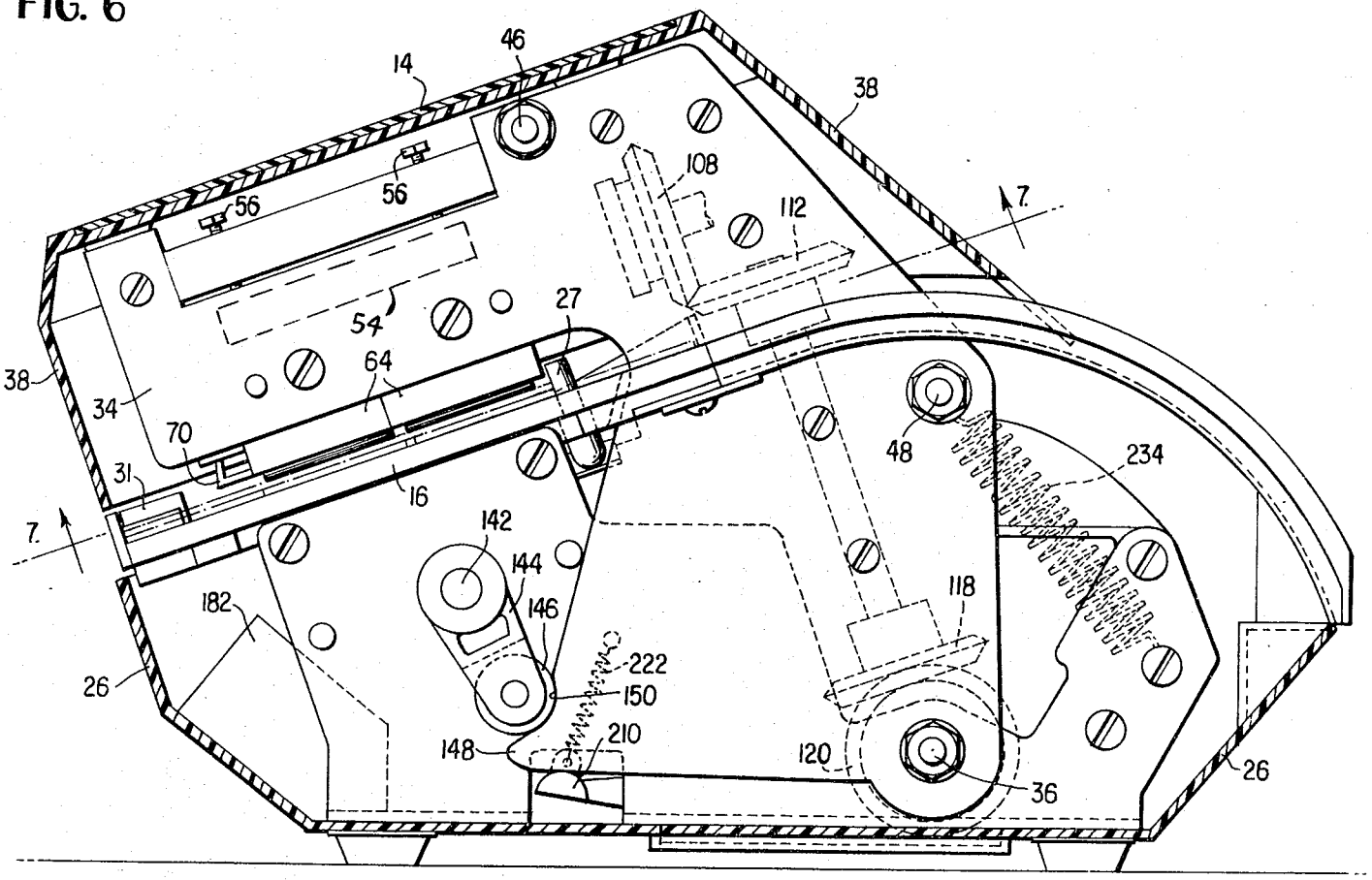
FIG. 6 is a side elevational view in partial cross-section of the imprinter with the head assembly closed.
Figure 7:
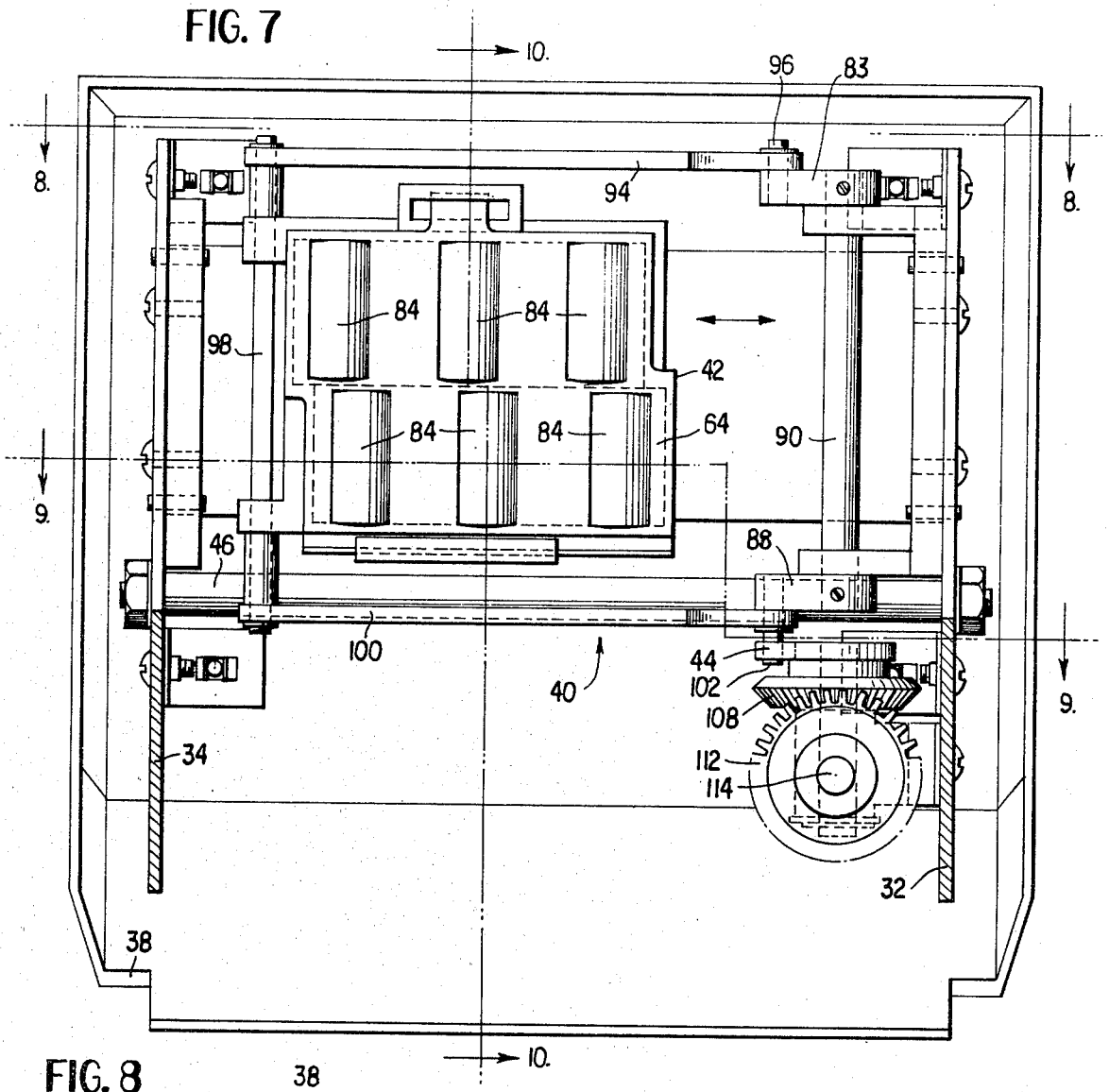
FIG. 7 is a bottom view of the imprinter head taken along the lines 7—7 of FIG. 6.

Upon closure of the head 14, the rollers 146 reside in curved recesses 150 formed in the arms 32,34 adjacent the projections 148 as shown in FIG. 6. After the rollers 146 engage recesses 150 to hold the head 14 in its closed position during the print cycle, the lock arms 144 are rotated a slight degree away from the projections 148 which serves, in turn, to rotate the arms 32,34 thereby forcing the roller platens 84 into engagement with the form 25 and data sources 18,20 and 24 to ensure the clear imprinting of same.

Referring now to FIGS. 14, 15, 16 and 17, the mechanism for rotating lock arm shaft 142 and the lock arms 144 away from the projections 148 to effect increased pressure on the roller platens 84 as aforementioned includes a first cam 152 secured to a gear 154 and rotatably driven therewith by gear 122 in which it is in meshing engagement. An actuating arm 156 is pivotably mounted on a shaft 158 and has a roller 160 which follows cam surface 162 of cam 152. The actuating arm 156 is connected to a link assembly 164 consisting of first and second link members 166, 168 respectively slidably secured with respect to each other by means of pins 170 and compression spring 172. The first link member 166 has an L-shaped recess 174 with a leg portion 175 in which is normally located a drive pin 176 connected to a lock arm shaft rotating lever 178 on lock arm shaft 142. As can be seen by referring to FIG. 14, as the cam 152 rotates in the clockwise direction (see arrow), the actuating lever 156 will be forced to rotate also in a clockwise direction by cam surface 162 thereby rotating the lock arm shaft 142 by means of link assembly 164 and drive pin 176. Rotation of the lock arm shaft 142 will move the lock arms 144 slightly out of the recesses 150 thereby exerting the aforestated pressure on the roller platens 84. In order to enable the head 14 to be opened in the event there is an electrical power failure or other malfuncton of the machine, an opening lever 180 is provided which is accessible through a port 182 in the front of the base housing 26. The opening lever 180 is rotatably mounted on lock arm shaft 142 and connected to the end 184 of first link member 166 by means of link 186. The lock arm shaft rotating lever 178 also has a release pin 188 which extends therefrom. As the opening lever 180 is moved clockwise, as viewed in FIG. 14, the geometry of link 186 will lift first link member 166 and leg portion 175 of recess 174 off of drive pin 176. Further, rotation of opening lever 180 will cause opening lever surface 181 to engage release pin 188 which is projected from lock arm shaft rotating lever 178 thereby rotating lock arms 144 out of recesses 150 and the path of projections 148 thereby permitting the head 14 to open. A coil spring 190 is positioned on the lock arm shaft 142 to bias the lock arm shaft rotating lever 178 in a counterclockwise direction as viewed in FIG. 14.

Because the lock arm shaft rotating lever 178 and shaft 142 connected thereto are so biased by spring 190, the pin 140 will be forced to keep switch actuating arm 138 depressed and switch 136 closed. Thus, the motor 124 will start running again when power is restored to thereby return the roller platen carriage 42 to its home position even though the head 14 is open to thereby correctly position it prior to the commencement of the next imprinting operation.

Figure 15:
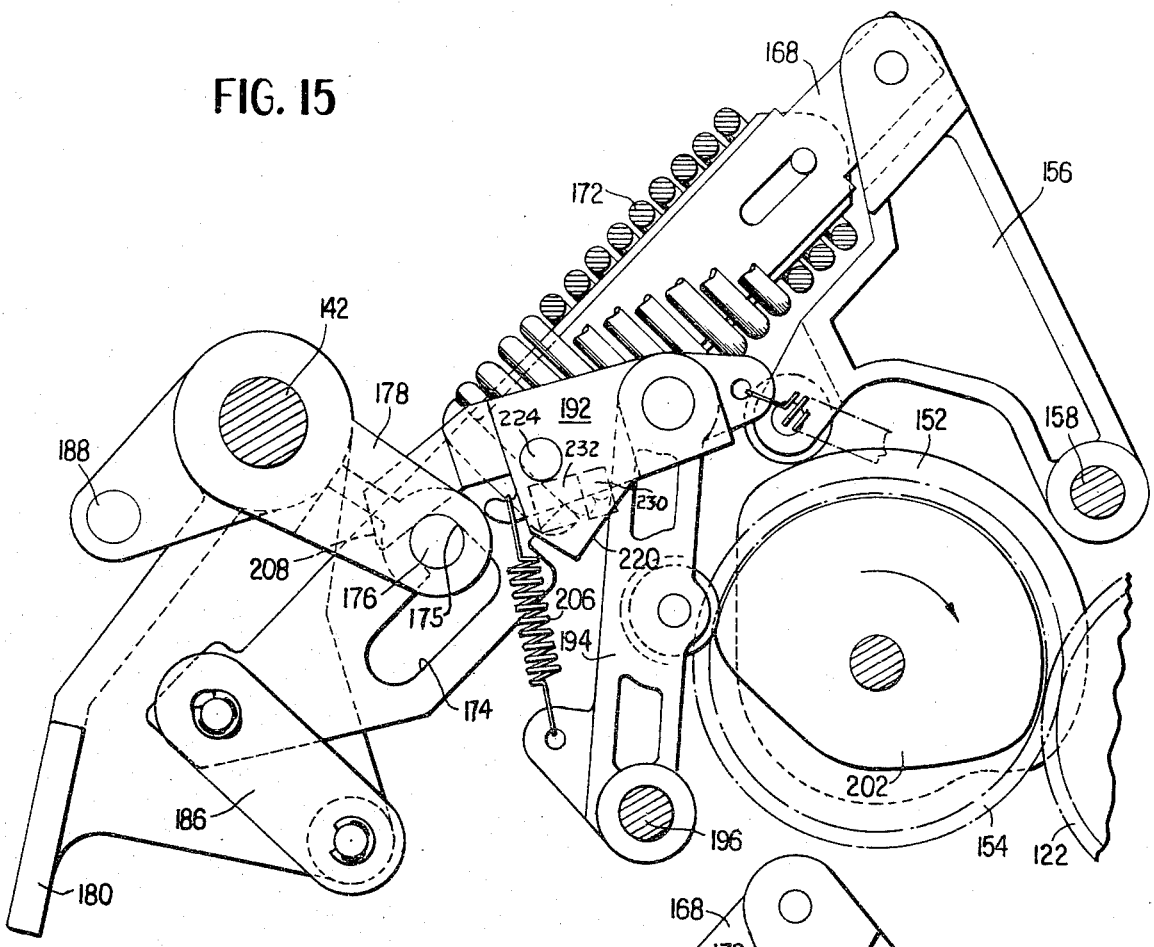
FIGS. 15 and 16 are sequential views of a part of the mechanism in FIG. 14 as the drive cam rotates.
Figure 16:
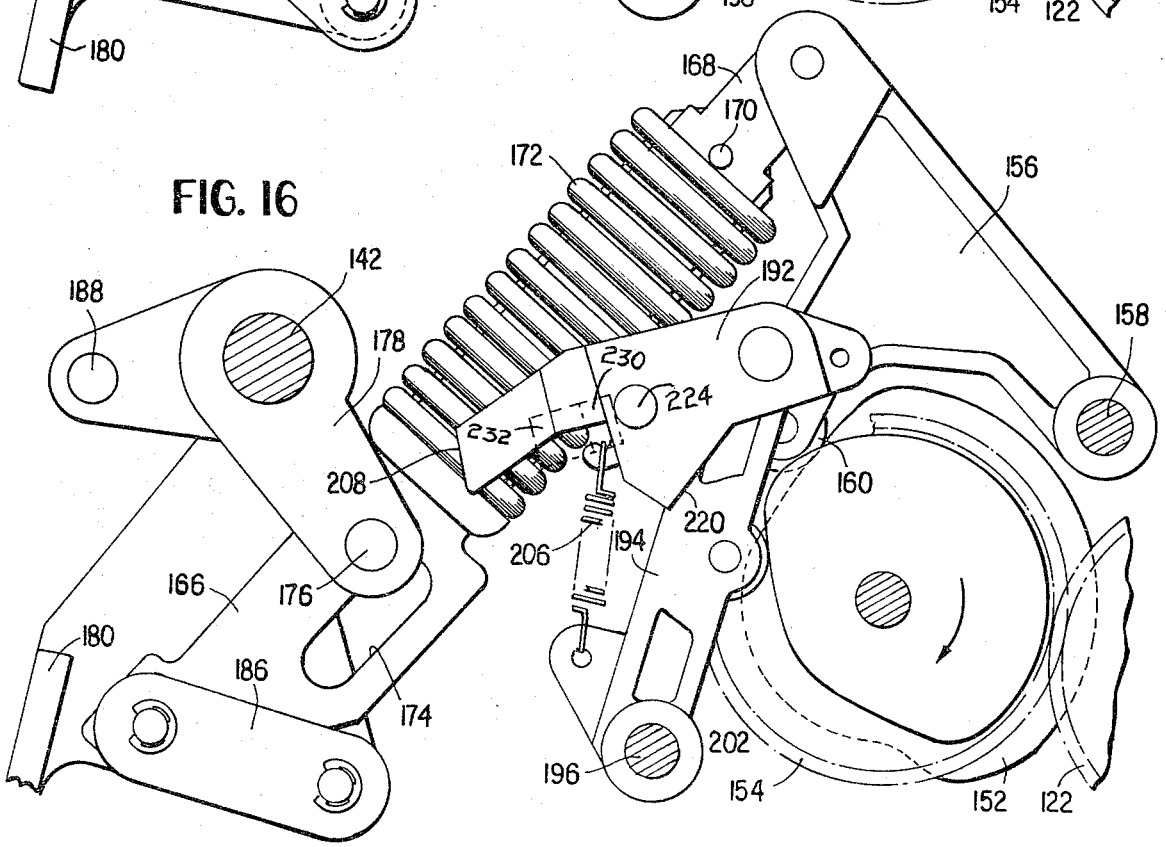
Figure 17:
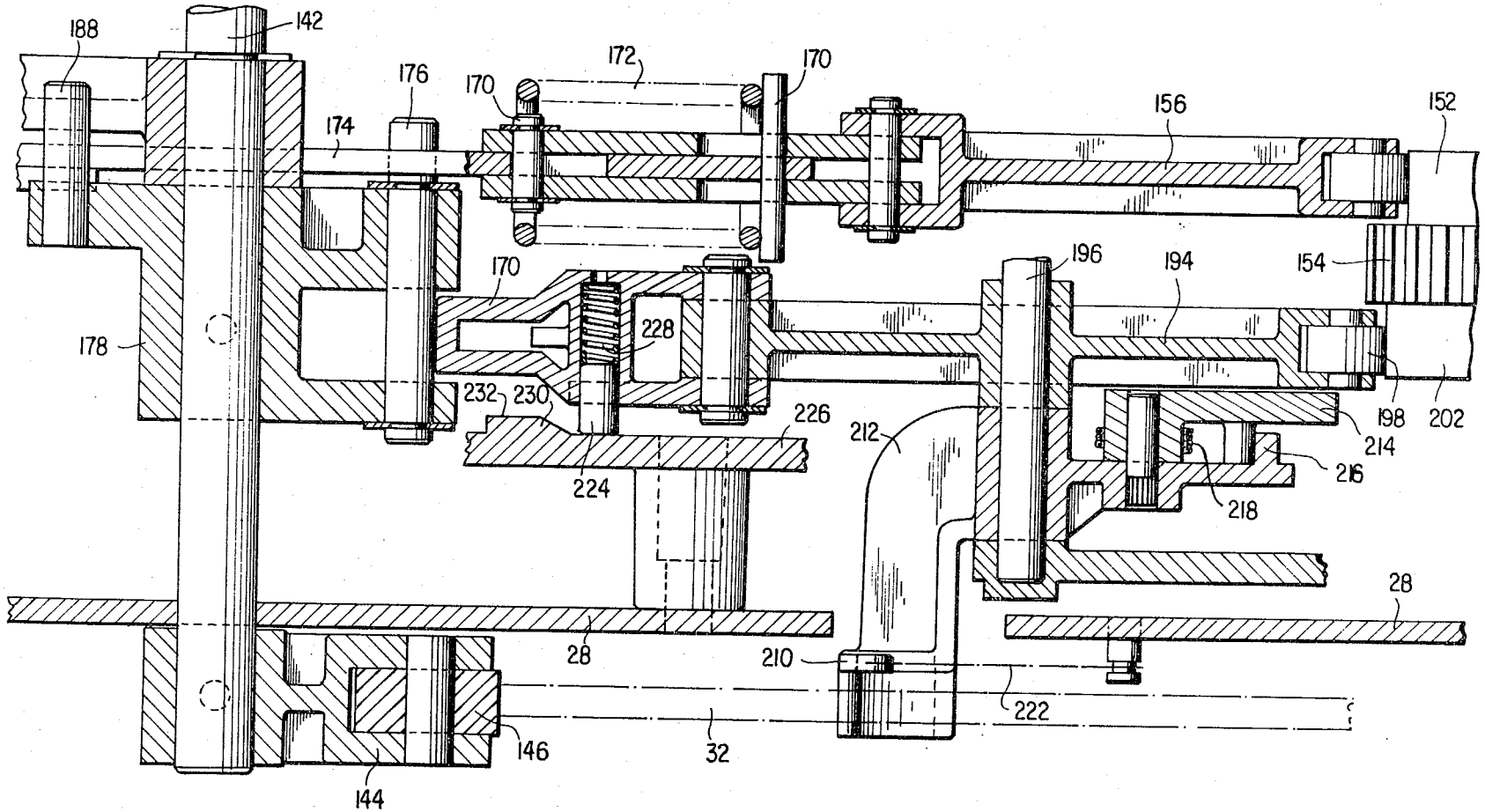
FIG. 17 is a bottom view of the drive mechanism of FIG. 14.

In order to maintain the lock arms 144 substantially out of the path of projections 148 on arms 32,34 to facilitate initial closure of the head 14 prior to commencement of the printing cycle, an interposer 192 is provided pivotably mounted at one end of a lever 194. The lever 194 is rotatably mounted at its other end on a shaft 196 and has roller 198 intermediate its ends which follows surface 200 of a second cam 202. The second cam 202 is secured to or integrally formed with gear 154 in the same manner as first cam 152. A tension spring 204 maintains the roller 198 in engagement with the cam surface 200 at all times and a tension spring 206 tends to maintain the interposer 192 in a downward position where it can engage drive pin 176. As the end 208 of interposer 192 abuts drive pin 176 as seen in FIG. 14, the lock arms 144 are held in a position slightly in the path of projections 148. As the projections 148 engage the rollers 146, the lock arms 144 are rotated to a point where the pin 140 engages actuating arm 138 on switch 136 starting motor 124. As the arm 34 approaches the downward limit of its travel, the projection 148 engages a foot 210 on a release lever 212 pivotably mounted on shaft 196 and having a strike arm 214 pivotably mounted on an end of the release lever 212. The release lever 212 has a stop 216 integrally formed therewith against which the strike arm 214 is biased by means of a spring 218. As the release lever 212 rotates, the strike arm 214 will engage surface 220 on interposer 192 forcing the interposer end 208 to a position above and out of the way of drive pin 176. A spring 222 biases the release lever 212 in a clockwise direction. As cam 152 rotates, the lock arms 144 are drawn against arms 32,34 via link assembly 164 as best seen in FIG. 15. If the thickness of the form 25 is greater than normal but not too great to prevent the switch 124 from closing, the compression spring 172 permits the lock arms 144 to stop while the actuating arm 156 continues its motion. In order to maintain the interposer 192 in particular the end 208 thereof, out of the path of the drive pin 176, a holdout pin 224 is slidably mounted in a side of the interposer 192 opposite a portion of a housing 226 enclosing the cams 152, 202, gear 154, lever 194, interposer 192 and release lever 212. The holdout pin 224 is outwardly biased by a compression spring 228 which maintains the holdout pin 224 against the housing 226. The housing 226 also has a holdout ramp 230 integrally formed therewith. When the end 208 of the interposer 192 is adjacent the drive pin 176, the holdout pin 224 is engaged with the surface 232 at the top of the holdout ramp 230, however, when the end 208 is forced clear of drive pin 176 by strike arm 214, the hold out pin 224 is forced off of surface 232 to a position above and adjacent the surface 232 thus preventing immediate return of the interposer 192 under the influence of spring 206 to a position behind drive pin 176. When the second cam 202 approaches its low point, the hold out pin 224 rides along the holdout ramp 230 and positions itself in line with the ramp itself. As the second cam 202 approaches its high point at the end of its cycle as best seen in FIG. 16, the holdout pin 224 is driven up the inclined surface back to its original position. By continuously holding out the interposer 192 throughout the cycle, the machine is able to reset itself after being manually opened by opening lever 180 since the lock arm shaft 142 is thus free to rotate to actuate the motor switch 136. Tension springs 234 are also provided to return the head 14 to its open position at the end of the printing cycle. A light source 236 is secured to the bed 16 adjacent the credit card 25 to illuminate same when the imprinter is operated in poorly lit environment.

OPERATION

Referring to the drawings, a credit card 24 is placed between the brackets 22 above the fixed and variable data areas 18,20 respectively. A form 25 to be imprinted with the embossed data is placed in the area bounded by projections 27 and stops 29,31. The head 14 is then manually brought forward to the point where projections 148 engage the lock arms 144 rotating them to start the motor 124. Rotation of cam 152 causes the lock arms 144 to forcefully engage the recess 150 via elements 156, 164, 176 and 178 to thereby exert additional pressure by the roller platens 84 against the form 25.

Figure 4:
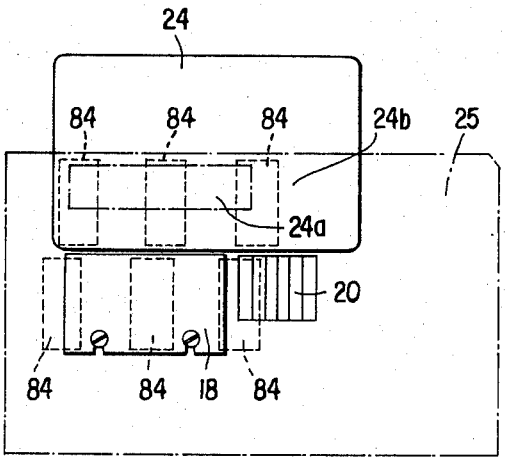
FIG. 4 is a schematic illustration of the position of the platen rollers at the start of the print stroke.
Figure 5:
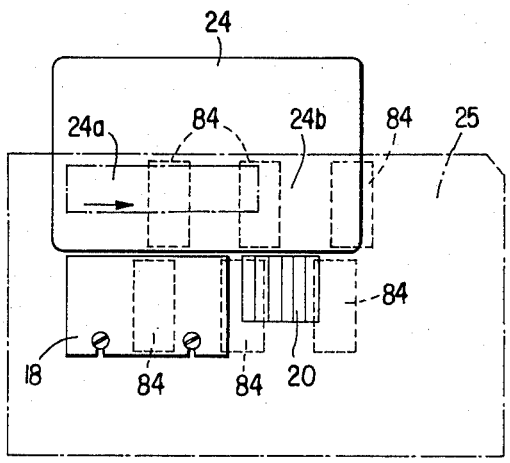
FIG. 5 is a schematic illustration of the position of the platen rollers as they travel across the embossed data.

Simultaneously with the aforedescribed action, rotation of gearing 108, 112, 118 and 120 causes the roller platen carriage 42 to move from its home position at the left as shown in FIG. 4 to the actuated position on the right as shown in FIG. 5. As can be seen, because of the number of spaced apart roller platens 84 in each row and the fact that all of them are brought into immediate contact with the form 25 upon closure of the head 14, the length of the stroke required to complete the imprinting operation is very short which enables the head assembly 40 and thus overall size of the imprinter 10 to be relatively small and compact. In addition, it will be noted that at least one of the roller platens 84 remains in contact with the printing elements 24*a* at all times; thus there is negligible "drop off" of any of the roller platens 84 onto the portion of the form 25 overlying the surface of the card 24 indicated at 24*b*, which could cause smudging and the like. Further, in the event that, for example, the variable data source 20 was eliminated, the roller platens 84 would not engage the form 25 causing smudging as they leave the surface of the fixed data plate 18 because the roller platen carriage 42 is securely maintained a specific distance above the bed 16 and parallel thereto by means of arms 50,52 and backup plate 54. In addition, because the roller platens 84 remain in contact with the form 25 at all times and effectively maintain it in place, imprinting can be achieved as the roller platen carriage 42 is returned from its actuated position on the right to its home position on the left without the danger of smearing or blurring the imprinted data. Because imprinting is achieved by the machine of the present invention during both the forward and return strokes of the roller platen carriage 42, only one-half as much downward pressure need be exerted by the roller platens 84 to accomplish the desired result. This results in longer life of the roller platens themselves as well as the embossed surfaces of the fixed and variable data sources. The machine could be designed to imprint only during the forward stroke by automatically lifting the roller platens a slight distance above the form 25 during the return stroke. Further, the invention may be employed in a bidirectional imprinter where printing of the credit card data (and transaction amount data) would be imprinted on the forward stroke and the dealer identification and date data would be imprinted on the return stroke.

As the roller platen carriage 42 returns to its home position on the left, the cam 152 will cause the lock arms 144 to release the arms 32,34 via elements 156, 164, 176 and 178 and spring 234 will open head 14. The roller platen cartridges 78, 80 can be easily replaced by simply bending latch 70 inward to remove frame 64 from the roller platen carriage 42 and then pressing out the cartridges 78,80, replace them and then reinsert the frame 64 in the roller platen carriage 42.

While preferred embodiments of the invention have been described and illustrated, it is to be understood that these are capable of variation and modification. Accordingly, the aim of the appended claims is to cover all such variations and modifications as may fall within the true spirit of the invention.

What is claimed is:

1. An imprinter comprising:

a base;

a head pivotably mounted with respect to said base;

at least one roller platen rotatably mounted with respect to said head;

an electric motor;

means for connecting said motor to said roller platen for moving the roller platen from a home position to an actuated position and then back to the home position;

a data containing printing member disposed on said base;

a least one document disposed over said printing member on said base;

means for latching said head with said base;

means cooperating with said latching means for energizing said motor;

means for unlatching said head with said base prior to said roller platen being returned by said motor to its home position in the event said motor becomes deenergized; and means for returning said platen to its home position upon re-energization of said motor independently of whether or not said head and base are relatched.

2. An imprinter comprising:

a base;

a head pivotably mounted with respect to said base between an open position and a closed position;

at least one roller platen rotatably mounted with respect to said head;

an electric motor;

means for energizing said motor including a switch through which said motor is energized, said switch including an actuating arm rotatable from a first position through a predetermined angle to a second position to close the switch and energize the motor;

means for connecting said motor to said roller platen for moving the roller platen from a home position to an actuated position;

a data containing printing member disposed on said base;

at least one document disposed over said printing member on said base;

means for latching said head with said base when the head is in its closed position, said means for energizing the motor cooperating with the latching means to energize the motor; and means responsive to (a) movement of said head from its open position to its closed position and (b) the thickness of said document being no more than a predetermined thickness for actuating said latching means and for rotating said actuating arm through said predetermined angle whereby, if the thickness of said document is greater than said predetermined thickness, said latching means will not latch the head in its closed position and the actuating arm will not be rotated through said predetermined angle so that the motor will not be energized.

3. An imprinter as in claim 2 wherein said means for connecting said motor to said roller also moves said roller from said actuated position back to said home position.

* * * * *